United States Patent [19]

Rabe

[11] 4,401,419

[45] Aug. 30, 1983

[54] MOTOR-COMPRESSOR

[75] Inventor: Erich Rabe, Nuremberg, Fed. Rep. of Germany

[73] Assignee: Electrolux Siegen GmbH, Siegen, Fed. Rep. of Germany

[21] Appl. No.: 189,139

[22] Filed: Sep. 22, 1980

[30] Foreign Application Priority Data

Sep. 21, 1979 [DE] Fed. Rep. of Germany ..... 2938255

[51] Int. Cl.[3] ..... F04B 17/00; F04B 35/04

[52] U.S. Cl. ..... 417/415; 310/68 B; 310/268; 318/254

[58] Field of Search ..... 417/415; 310/268, 68 B; 318/254 A; 184/26, 31; 415/90

[56] References Cited

U.S. PATENT DOCUMENTS 2,797,857 7/1957 Warner ..... 417/415

3,896,357 7/1975 Tanikoshi ..... 318/254 A 4,167,691 9/1979 Sorensen et al. ..... 318/138

4,174,484 11/1979 Schmider ..... 310/268 X 4,238,717 12/1980 Knight et al. ..... 318/341

*Primary Examiner*—Richard E. Gluck

*Assistant Examiner*—Peter M. Cuomo

*Attorney, Agent, or Firm*—Joel M. Freed

[57] ABSTRACT

A motor-compressor for a refrigerator includes a housing containing a lubricant and a reciprocating compressor driven by a direct-current electric motor having a disc-shaped rotor and stator. The stator is located between magnetic flux closing discs of the rotor and carries electronically commutated drive coils. Goniometric indicators detect the position of the rotor and cause signals to be applied to an alternating current generator which modulates a bridge circuit to provide current flux for driving the rotor.

2 Claims, 3 Drawing Figures

MOTOR-COMPRESSOR

BACKGROUND OF THE INVENTION

The invention relates to a motor-compressor, particularly for refrigerating machines of small dimensions.

Motor-compressors for refrigerating machines, such as domestic refrigerators, freezers and air-conditioning appliances, are known in many different constructions. They serve to compress the gaseous refrigerating agent introduced into a housing of the motor-compressor. The compressor forms, conjointly with an electric motor, a preassembled subassembly which is suspended or braced resiliently in the gas-tight and pressure-tight housing. Known electric motors having a hollow cylindrical stator and a cylindrical rotor are normally used, and the rotor shaft is generally arranged offset at 90° to the compressor piston and drives the piston via a connecting-rod. In order to reduce the operating noise of the compressor, silencer chambers, either separate from or integrated into the cylinder housing, are provided which are connected by flow channels to the admission and expulsion valve group in the cylinder head. Due to the use of cylindrical electric motors and their physical association with the compressor, such motor-compressors are comparatively wide which can be accepted in large refrigerating machines, e.g., domestic refrigerator cabinets and freezing chests. However, if the refrigerating machines have smaller dimensions, such as in camping vans or caravans, as transportable units then considerable difficulties of arrangement arise which are attributable particularly to the relatively great width of the unit. Since in the case of the above mentioned applications, the only electrical energy available is frequently that generated in the vehicle itself or by a particular unit, the energy and power consumption of such refrigerating machines with their motor and compressor in a housing is a considerably more important factor than is the case, for example, with normal mains-operated domestic refrigerator cabinets. It is therefore important that an adequately high torque is available for starting the piston compressor, because a comparatively high pressure generally acts upon the piston end and the electric motor therefore has to start under load. In order to keep the power consumption within limits in spite of this fact, it is also necessary for the energy consumption of the electric motor to be adapted to the relevant operating loads of the refrigerating machine.

The object of the invention is to produce a motor-compressor which fulfills the above-mentioned desiderata, that is one in which dimensions can be small, the electric motor of which can develop a high torque when starting, and the energy consumption of which can be adapted to the operation of a refrigerating machine.

SUMMARY OF THE INVENTION

According to the present invention there is provided a motor-compressor for a refrigerator, including a pressure tight outer housing containing a lubricant, a reciprocating compressor and an electric motor for driving the compressor; wherein the compressor comprises a piston slidable within a cylinder and a connecting rod connected between the piston and the motor; and the motor is a direct-current motor and comprises a disc-shaped rotor provided with permanent magnet means and magnetic flux closing discs, a disc shaped stator which is located between the magnetic flux closing discs so as to maintain a precise interval and which carries a plurality of electronically-commutated drive coils located in an air gap and generally in a single plane; and an electronic control system comprising goniometric indicator means for detecting the position of the rotor, bridge circuit means for generating currents for driving the rotor, and an alternating current generator for modulating the bridge circuit means in accordance with signals received from the goniometric indicator means, which generator is commutated for rotation of the rotor in a predetermined direction.

One of the essential advantages of the motor-compressor according to the invention is that its external dimensions can be reduced several times compared to known appliances, this being ultimately attributable to the specific construction of the electric motor and to its physical association with the piston compressor. By using an electronically commutated direct-current motor in conjunction with a permanent magnet arranged on one side of the rotor disc, however, not only are the desired small external dimensions of the unit achievable but it is also possible to utilize the favorable starting behaviour characteristic of this motor, that is a high starting torque is available. The disc-shaped construction of the rotor and stator also permits an extraordinarily accurate adjustment and maintenance of the air gap, which in turn has a favorable influence upon the motor efficiency.

By preferably providing a relatively heavy permanent magnet on the disc rotor in conjunction with two magnetic flux closing plates, it is possible for the rotor to have a comparatively large mass, so that it acts simultaneously as a flywheel and high uniformity of the torque is therefore ensured.

By preferably providing a cranked construction to the connecting rod and mounting the connecting rod on the rotor on only one side thereof a further reduction of the dimensions of the overall unit is possible, because the disc rotor is at least partially housed in the space obtained by the cranking, so that the centre of gravity of the motor lies in or near the longitudinal axis of the cylinder.

The electronic starting control device, for the direct-current motor, comprises one or more goniometric indicators which detects the relevant standstill position of the rotor fitted with the permanent magnet, and by the signals of which, determining the direction of rotation as a function of the polarity, the drive coils of the stator are modulated through a bridge circuit.

In order to start the direct-current motor, the position of the n-poled rotor permanent magnet with reference to the position of the stator coils is detected by the goniometric indicator, for example, a Hall generator. By preferably providing voltage comparators, corresponding signal impulses with the relevant polarity can pass through outputs to an electronic comparison circuit and to a generator.

In a specific arrangement, by means of time constant of an RC circuit, a generator can generate a frequency which corresponds to a desired nominal speed. The outputs respectively block the output impulses appearing at the outputs of the generator. These impulses control power stages consisting of current-amplifying components which excite the drive coils in a bridge circuit. Because these drive coils lie in the magnetic flux, a rotation of the rotor by one pair of poles occurs. After this the permanent magnet has an opposite polarity with reference to the goniometric indicator, so that the described process is repeated, displaced in phase electrically through 180°. This sequence is continued up to the frequency which corresponds to the RC combination.

If by chance the goniometric indicator is located in a neutral zone between north and south pole of the rotor magnet, no position detection occurs. In this case the arrangement may be such that the output of the comparison circuit excites the starter coil because no polarity exists at the outputs of the voltage comparators. The current flux in the starter coil leads to a rotation of the rotor magnet with reference to the goniometric indicator, so that the latter scan assume its control function. After starting, the comparison circuit is taken out of operation and the starter coil assumes the function of a tachogenerator. The generated voltage U2 is a direct-current measured quantity for the speed and now serves as a correction control quantity for a comparator stage regulating the rotor speed, which regulates the modulation time for the power stage of the drive coils in a correcting sense through a pulse width modulation.

If the operating voltages should not remain constant, for example where vehicle batteries in a varying state of charge are used, a comparator may be provided to compare the operating voltage with an internal reference voltage. If the operating voltage falls below a predetermined value, then the generator is switched off. It is switched on again only when the operating voltage exceeds a preselected value. The ratio between switch-off and switch-on process is a switching hysteresis.

The motor may be such that comparatively high forces and torques occur and so it may be necessary to anchor the stator windings firmly in the stator housing. This may be done in a particularly simple manner by using a coil support in the form of a compression moulding or injection molding, in which the flat windings of the drive coils and also the starter coil are arranged in the same general plane and are fixed by encasing with a suitable plastics material. The production process of a stator becomes particularly simple if the packing of the support and the encasing of the coils is effected simultaneously in a single work stage.

In order to ensure adequate cooling of the components of the electronic regulating and control device without appreciably widening the unit, the components of the electronic control or communication system may be arranged within the housing which may be cooled, on the rear wall of a common support plate of the electric motor and the compressor. In this way the individual components are bathed in a flow of cooling medium contained in the housing. The arrangement of the electronic components within the housing has the further advantage that only two electrical connections need be provided in the housing.

For compressors of small dimensions the so-called dead space between the piston end in the TDC position and the associated cylinder end face has a considerable influence upon the power behaviour of the compressor. In order to reduce this dead space, a spring plate of an admission valve may be made circular and with a diameter corresponding to the cylinder diameter. In this way it fills the entire surface in the cylinder head during compression and acts virtually as a continuous boundary surface of the cylinder chamber. It is particularly convenient to attach this spring plate to a valve seat plate by means of a hollow rivet, because then the interior space of the hollow rivet can serve simultaneously as a discharge orifice. A further reduction of the dead space can also be achieved if a corresponding recess for the head of the hollow rivet is provided in the piston end.

BRIEF DESCRIPTION OF THE DRAWINGS

An embodiment of the invention will now be described by way of example and with reference to the accompanying drawings in which.

DESCRIPTION OF PREFERRED EMBODIMENT

Figure 1:
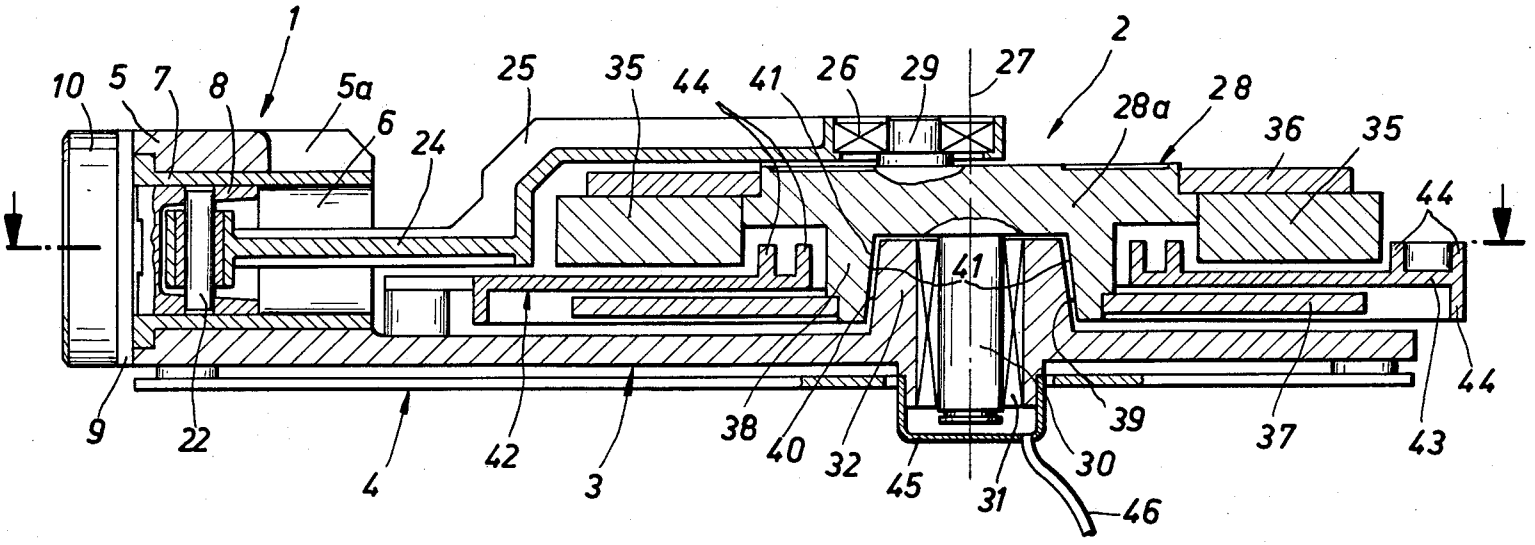
FIG. 1 shows a longitudinal section of a motor-compressor without an outer housing.
Figure 2:
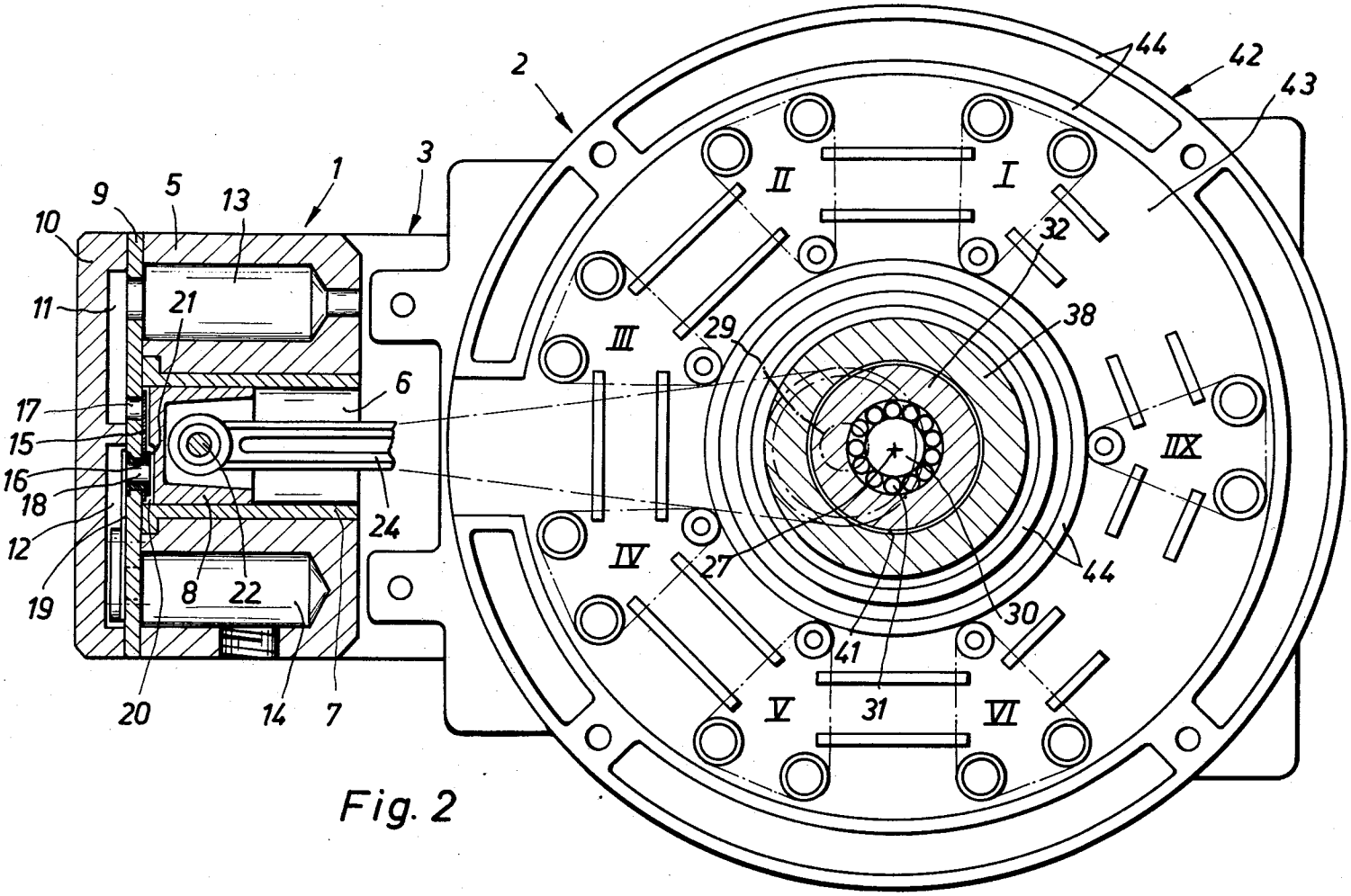
FIG. 2 shows a longitudinal section of the motor-compressor, without an an outer housing, effect at 90° with reference to FIG. 1.
Figure 3:
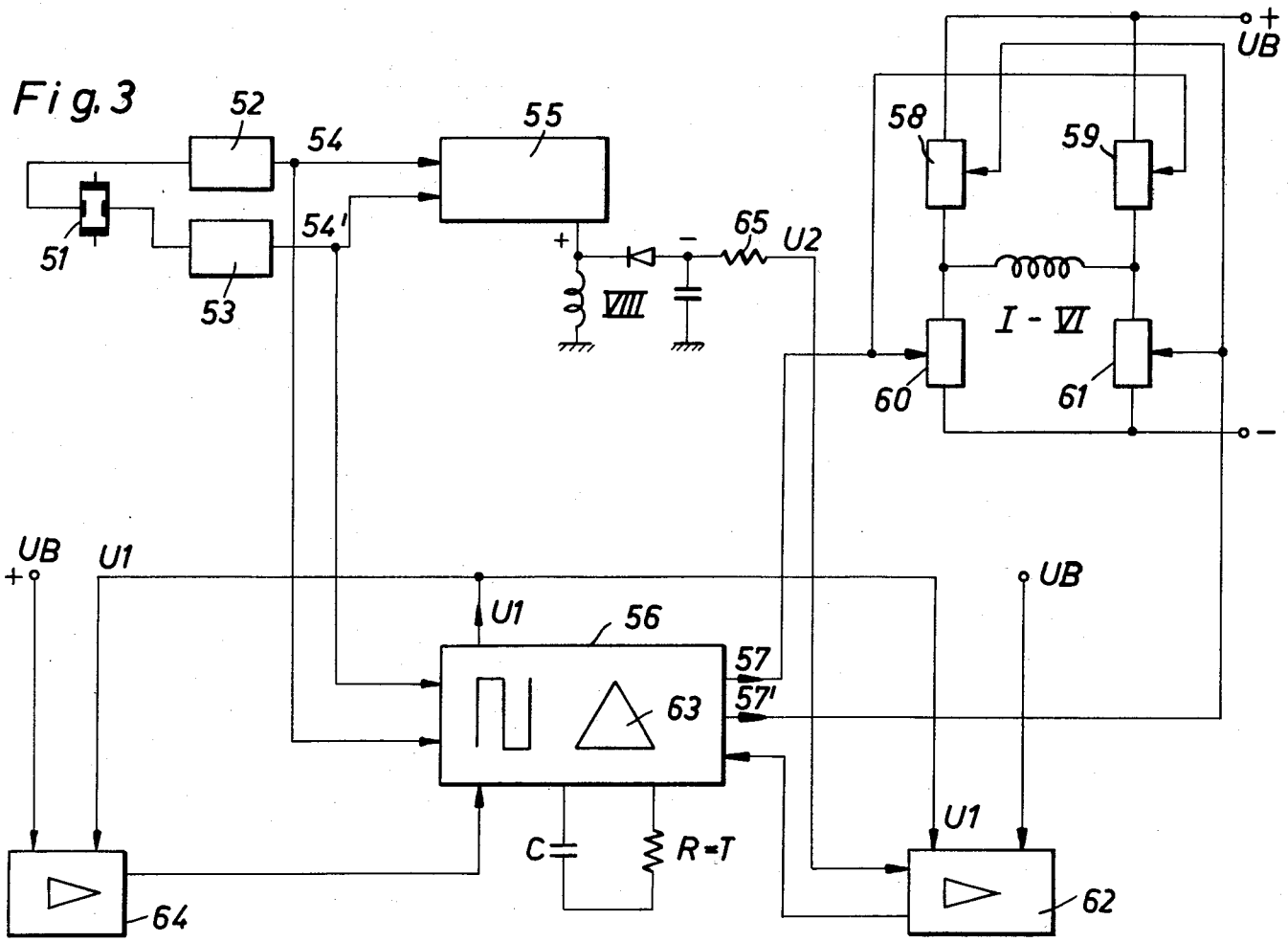
FIG. 3 shows a block circuit diagram of an electronic control system of the electric motor.

The motor-compressor illustrated in FIGS. 1 and 2 comprises a compressor 1, an electric motor 2, a common support plate 3 for the compressor 1 and the electric motor 2, and an electronic control system 4 arranged in a cooling stream on the outside of the support plate 3.

The compressor 1 comprises for example a injection die-cast cylinder housing 5, a cylinder 6, an inserted cylinder bushing 7 and a sealed piston 8 guided slidingly in the latter. The cylinder 6 is closed at one end by a valve plate arrangement 9 and a cylinder head 10, in which suction-side and pressure-side flow channels 11, 12 are machined. Laterally beside the cylinder 6 there are provided in the cylinder housing 5 one admission chamber and one pressure chamber 13 and 14 respectively, which are aligned with axes parallel to the axis of the cylinder and can therefore be produced by simple machining from the cylinder end face without reclamping the toolpiece, and act as silencers.

As may be seen from FIG. 1, in order to facilitate the assembly the cylinder housing 5 is provided with a port **5*a*, the width of which is slightly greater than the diameter of the piston 8, so that the piston 8 preassembled on the electric motor 2 can be introduced laterally into the cylinder housing 5**.

An intake valve plate 15 attached by means of a hollow rivet 16 to the plane end face by a valve plate 9 on the right-hand side in FIG. 2 is in the form of a circular disc having a diameter which is only just sufficiently smaller than the cylinder diameter to enable it to execute the valve movements. The dead space in the TDC region, which is prejudicial to the compressor power, is effectively reduced by this construction of the intake valve plate 15. Also for this purpose, a turned groove 20, the depth of which corresponds to the projecting rivet head 21 of the hollow rivet 16, is provided in the end wall of the piston.

Mounted on a crosspin 22 in the piston 6 by means of a bearing 31 is a connecting rod 24 made for example of cast aluminum, which is cranked in its central region 25 and mounted by its free end by means of a bearing 26 on a stud 29 attached to the outside of a rotor 28 eccentrically of the axis of rotation 27 of the rotor 28. The cranked connecting rod 24, 25 may have an appropriately profiled cross-section for stiffening purposes. It is also possible to anchor the stud 29 to the end of the connecting rod and to arrange the bearing 26 in the rotor 28 eccentrically of the axis of rotation 27.

The electric motor 2 is a direct-current motor, the rotor 28 of which comprises a central profile disc **28*a*. A journal 30 centered in the profile disc 28***a* is mounted via a bearing 31 in a hollow cylindrical part 32 of the support plate 3, whilst the journal 30 projects only to the inner end face of the profile disc 28*a*. A permanent magnet 35 magnetised laterally with n poles is attached rigidly to the profile disc 28*a*. This magnet 35 is also attached to an outer magnetic flux closing ring or disc 36, which acts together with a further inner magnetic flux closing ring or disc 37 to close the magnetic flux. This inner magnetic flux closing disc 37 is attached to an annular projection 38 on the profile disc 28*a*, the inner surface 39 of which projection are conical end, together with conical surfaces 40, define a frustoconical annular channel 41. These conical surfaces 39, 40, by centrifugal effect, cause an intensive flow of lubricating and cooling medium in the annular channel 41 and thus act as a lubricant pump. A masking cap 45 surrounds the free end of the journal 30. A hose 46 secured in this cap 45 leads into an oil sump. Due to the centrifugal effect of the conical ring channel 41, a suction effect is produced in the space covered by the cap 45 via the bearing 31 and causes a flow of lubricant from the oil sump through the hose 46 to the bearing 31.

Attached to the support plate 3 is a disc-shaped stator 42, which carries the drive coils I to VI shown schematically in plan in FIG. 2 in mutually uniform angular pitch, and a starter coil IIX which is electrically phase-shifted with respect to the drive coils, and, which in construction illustrated is located in the median axis of the motor-compressor. The drive coils and also the starter coil are arranged flat in a support 43 made of plastic and fixed in position by encasing with this plastic material. The plastic support 43 has a plurality of ribs 44 for stiffening purposes. Due to the embedding of the coils into the plastic material of the support 43 and the arrangement of this support part between the magnet 35 and the magnetic flux closing disc 37 of the rotor 28, plane air gaps capable of highly accurate adjustment are obtained, which do not change even after long periods of operation, because no, or only very weak, tilting magnets act upon the rotor.

The individual components of the electronic regulating and control device 4 are attached to the rear side of the support plate 3.

In the circuit arrangement illustrated, a goniometric indicator provided for detecting the relative position of the rotor magnet with reference to the stator coils is a stationary Hall generator 51, the two outputs of which lead to two voltage comparators 52, 53 which are operational amplifiers. The Hall generator 51 is conveniently associated physically with the starter coil IIX. The two outputs 54, 54' of the comparators 52, 53 are connected firstly to an electronic comparison circuit 55 and securely to a generator 56, which generates through an RC-circuit a signal phase frequency corresponding to the desired nominal speed. Two outputs 57, 57' of this generator 56 which acts as a voltage regulator and pulse width modulator, lead to power amplifiers, the components 58–61 of which are wired as a double bridge. Two comparator stages 62, 64 are also connected to the generator 56.

Upon switching on, before the motor starts, the Hall generator 51 detects the relative position of the permanent magnet 35 of the rotor 28 with reference to the stator coils. Depending upon the position and polarity detected, the signal impulses of one of the voltage comparators 52 and 53 are amplified and pass to the generator 56 which includes a triangular waveform (delta) generator 63, and whose output modulates the corresponding components 58, 60 or 59, 61 of the power stages for the drive coils I to VI. The excitation of the drivecoils causes a rotation of the rotor by one pair of poles. The fresh rotor position is again detected by the Hall generator 51 and the control process is repeated, although a phase displacement through 180° has occurred and the respective other components of the amplifiers and of the power stages now become effective.

A case may occur that, before the motor is started, a neutral region between two magnet poles is precisely opposite the goniometric indicator, i.e., the Hall generator 51, so that the Hall generator cannot react. The starter of IIX in the stator 42 is provided for this special case; it is excited through the comparison circuit 55 and causes a rotation of the rotor 28 due to its electrical phase displacement. This rotor rotation is sufficient to render the goniometric indicator effective, whereupon the further starting process is completed in the above-described manner. After this first starting phase the comparison circuit is disconnected. The starting coil then acts as a tachogenerator. The generator voltage U2 is fed through a filter chain 65 to the comparator stage 62 and compared in the latter with an internal reference voltage U1 generated in the generator 56 and with the operating voltage UB. This comparator stage 62 therefore regulates the speed of the rotor, with the aid of the pulse width modulator 56 which modulates the operation of the power supply components 58 to 61 for the drive coils.

The operating voltage UB is compared with the internal reference voltage U1 in the comparator stage 64. As soon as the operating voltage falls below a prescribed value, the generator 56 is switched off. This ensures that in the event of diminishing power of the energy source, for example, of a vehicle battery, the withdrawal of current by the motor-compressor is also eliminated.

The invention is not restricted to the features and measures illustrated and described. Thus it is possible and convenient to provide, either in the air gap of the rotor magnet or within its field, a separate permanent magnet which always rotates the rotor into a position relative to the goniometric indicator such that the motor starts immediately upon switching-on. The starting control system can be simplified by this arrangement. Because the piston is moved into its BDC position by the pressure in the cylinder after the motor is switched off, the eccentric bearing 29 of the piston rod 24, 25 then occupies the right-hand end position in FIG. 1, and due to the sinusoidal movement cycle only comparatively weak forces need be exerted by the permanent magnet and/or the starter coil to move the motor out of its position when starting, because the piston stroke and hence the counter-pressure are very small.

I claim:

1. A motor-compressor for a refrigerator, including:

(A) a direct current motor comprising:

(1) disc shaped rotor means presenting a conical surface portion and acting as a flywheel of large mass, said disc shaped rotor means being provided with (a) permanent magnet means, (b) spaced disc means for closing the magnetic flux, and (c) a central part, of diamagnetic material, to which said permanent magnetic means and said magnetic flux closing discs are attached;

(2) disc shaped stator means located between said spaced disc means so as to maintain a precise planar air gap;

(3) a plurality of electrically commutated drive coils carried by said stator means and located in said air gap generally in a single plane; and (4) a starter coil arranged in the stator means in the same plane as said drive coils and electrically phase shifted therefrom;

(B) an electronic system comprising:

(1) goniometric indicator means for detecting the position of such rotor means relative to said stator means, said goniometric indicator means being operable to generate signals determining the direction of rotation of said rotor means as a function of the polarity of the permanent magnet means;

(2) bridge circuit means for generating current flux for driving the rotor;

(3) alternating current generator means, commutated for rotation of said rotor in a predetermined direction, for modulating said bridge circuit means in accordance with signals received from said goniometric indicator means;

(4) modulating control circuit means for starting the motor which excites said starter coil when no definite polarity is present;

(5) a delta generator for modulating pulse widths; and (6) a filter chain associated with said starter coil to modulate said delta generator as a function of the speed of said rotor means which is a function of load;

(c) a reciprocating compressor driven by said motor and comprising:

(1) a piston slidable within a cylinder bushing of a cylinder assembly, which cylinder assembly includes a lateral port for receiving said piston during assembly; and (2) a connecting rod connected between said piston and said motor and having a cranked part which is mounted on an external face of said disc shaped rotor means eccentrically of its axis of rotation; and (D) support plate means attached to said compressor and to one side of said disc shaped rotor means, said support plate means including:

(1) means defining a lubricant sump into which said rotor means at least partly extends; and (2) a bearing attachment presenting a conical surface portion, which conical surface portion together with said conical surface portion presented by said rotor means, defines a frustoconical annular channel serving as a centrifugal lubricating pump.

2. The motor-compressor according to claim 1, wherein said goniometric indicator means comprises a Hall generator associated with said drive coils.

* * * * *